US007993177B2

(12) United States Patent
Goode

(10) Patent No.: US 7,993,177 B2
(45) Date of Patent: Aug. 9, 2011

(54) SYSTEMS AND METHODS FOR LOAD DISTRIBUTION

(75) Inventor: David Paul Goode, Huntsville, UT (US)

(73) Assignee: D2 Investments, LLC, Ogden, UT (US)

( * ) Notice: Subject to any disclaimer, the term of this patent is extended or adjusted under 35 U.S.C. 154(b) by 361 days.

(21) Appl. No.: 12/136,842

(22) Filed: Jun. 11, 2008

(65) Prior Publication Data

US 2009/0311927 A1 Dec. 17, 2009

(51) Int. Cl.
*B63B 35/85* (2006.01)

(52) U.S. Cl. ..... 441/69; 2/161.1; 182/3; 482/124; 482/126

(58) Field of Classification Search ..... 441/69, 441/88; 482/23, 24, 121, 124, 126; 2/161.1, 2/162; 182/3, 4, 5; 294/15
See application file for complete search history.

(56) References Cited

U.S. PATENT DOCUMENTS

| | | | | |
|---|---|---|---|---|
| 1,402,179 | A * | 1/1922 | Piscitelli | 482/124 |
| 3,494,319 | A * | 2/1970 | Dunlap | 441/69 |
| 4,194,257 | A * | 3/1980 | Martin et al. | 441/80 |
| 4,235,182 | A * | 11/1980 | Burger | 441/69 |
| 4,263,685 | A | 4/1981 | Neuscheler | |
| 4,400,831 | A | 8/1983 | Rietz | |
| 4,720,279 | A | 1/1988 | Fritschen et al. | |
| 4,745,870 | A | 5/1988 | Roth | |
| 5,449,309 | A | 9/1995 | McCarty | |
| 5,695,372 | A | 12/1997 | Hilleren | |
| 5,809,570 | A | 9/1998 | Grover | |
| 6,645,027 | B2 * | 11/2003 | Miller | 441/88 |
| 2006/0234833 | A1 | 10/2006 | Rastegar et al. | |

FOREIGN PATENT DOCUMENTS

| | | |
|---|---|---|
| EP | 0043107 | 1/1982 |

OTHER PUBLICATIONS www.clincherglovES.com.

* cited by examiner

*Primary Examiner* — Lars A Olson
(74) *Attorney, Agent, or Firm* — Trent H. Baker; Baker & Associates PLLC

(57) ABSTRACT

One embodiment of the present invention relates to a water ski load distribution system for anatomically distributing tow rope induced forces across a participant. The system includes an abdominal encircling member, a rigid rear support member, a pair of wrist encircling members, and an elongated flexible member. The abdominal encircling member extends around the user's abdomen and may be incorporated within a personal flotation device. The rigid support member extends vertically on the back region between the abdominal encircling member and the user's shoulder region. The elongated flexible member extends between the wrist encircling members and the rigid support member. The length of the elongated flexible member prevents the user from simultaneously extending both arms at the shoulder joint. The wrist encircling members may optionally include load distribution systems that distribute pulling forces directly from a grip induced object to the wrists.

20 Claims, 7 Drawing Sheets

SYSTEMS AND METHODS FOR LOAD DISTRIBUTION

FIELD OF THE INVENTION

The invention generally relates to load distribution systems. In particular, the present invention relates to an anatomical load distribution system for distributing pulling forces upon a user.

BACKGROUND OF THE INVENTION

Many athletic and manual based activities require participants to tolerate and counteract particular pull-based forces. Pull-based forces are defined as forces that are directed away from a particular portion of a participant's body. For example, a mason lifts bricks which due to their inherent weight cause a gravitational pulling force. The brick layer must counteract in order to transfer the bricks from one location to another. Likewise, the sport of water skiing requires participants to continually grasp a tow rope handlebar and counteract pulling forces so as to maintain a standing position over the water with one or more ski platforms. The continual or repeated counteraction of these types of pulling forces causes muscular strain on particular portions of the human body and may therefore prevent or limit participation in these activities. Older or disabled individuals in particular may be unable to withstand the necessary muscular strain and may therefore be forced to abstain or minimize the time in which they engage in these types of activities. Likewise, able bodied participants may become fatigued as a result of the required muscular strain and thus be forced to restrict the duration of which they participate in these activities.

Unfortunately, existing systems have failed to adequately solve this problem. Numerous ergonomic systems are designed to prevent injury and reduce strain by maintaining proper postural alignment. However, proper posture does not significantly reduce muscular strains associated with pulling forces. Other systems provide an artificial anatomical support structure in order to absorb forces upon the body. For example, lower lumbar type support belts commonly compress and/or support the lower region of a wearer's torso and back to absorb forces that may otherwise cause injury. However, these systems also fail to affect all of the muscles involved in counteracting pulling forces such as hands, arms, upper back, etc. In addition, various adjustments may be made to the item in direct contact with a participant during pull based force activities. For example, water ski tow rod/handlebar surface area textures improve frictional forces with a user's hand in an effort to reduce grip based muscular strain. Likewise, a mason may use various pincher type tools to pick up bricks to eliminate grip strain. These systems fail to adequately accommodate the multiplicity of independent muscular strains involved in the counteraction of pull-based forces.

Therefore, there is a need in the industry for a load distribution system that effectively minimizes the muscular strains involved in activities that require counteracting pulling forces.

SUMMARY OF THE INVENTION

The present invention relates to a load distribution system for anatomically distributing pulling forces. One embodiment of the present invention relates to a water ski load distribution system for anatomically distributing tow rope induced forces across a participant. The system may be utilized to efficiently distribute muscular forces necessary to counteract the tow rope pulling forces during water skiing. The system includes an abdominal encircling member, a rigid rear support member, a pair of wrist encircling members, and an elongated flexible member. The abdominal encircling member extends around the user's abdomen and may be incorporated within a personal flotation device. The rigid support member extends vertically on the back region between the abdominal encircling member and the user's shoulder region. The elongated flexible member extends between the wrist encircling members and the rigid support member. The length of the elongated flexible member prevents the user from simultaneously extending both arms at the shoulder joint. In operation, pulling forces are transferred from the wrist encircling members to the rigid support member and then to abdominal encircling member. The wrist encircling members may optionally include load distribution systems that distribute pulling forces directly from the grip induced object to the wrists. Alternative embodiments of the present invention utilize the system for non-water skiing grip induced pulling force distribution. A second embodiment of the present invention relates to a method for anatomically distributing grip induced forces. The method includes extending an elongated flexible member between the user's wrists and a rigid support member, levering the rigid support member against the user's back, and abdominally circumferentially retaining the rigid support member in proximity to the user's abdomen. The method may optionally include additional acts to distribute grip induced pulling forces directly from an object to the user's wrists.

Embodiments of the present invention represent a significant advance in the field of anatomical pulling force distribution. Participants in activities that require counteracting pulling forces are able to efficiently distribute forces to the abdominal region, thereby minimizing muscular strain. Pulling forces are induced upon any participant lifting heavy objects so as to counteract gravity or participation in activities that require counteracting artificially type pulling forces such as water skiing.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
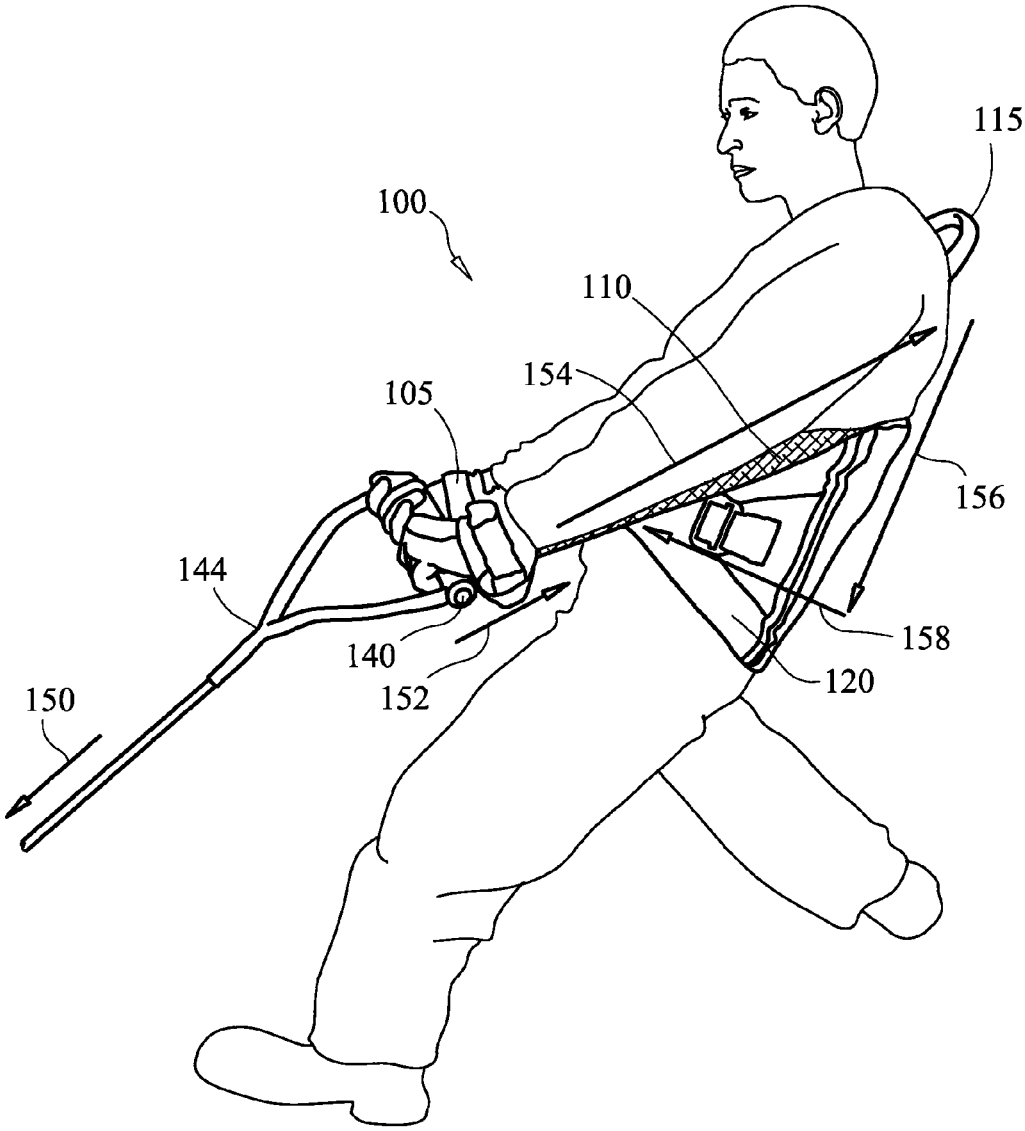
FIG. 1 illustrates an operational perspective view of a load distribution system in accordance with one embodiment of the present invention.

The present invention relates to a load distribution system for anatomically distributing pulling forces. One embodiment of the present invention relates to a water ski load distribution system for anatomically distributing tow rope induced forces across a participant. The system may be utilized to efficiently distribute muscular forces necessary to counteract the tow rope pulling forces during water skiing. The system includes an abdominal encircling member, a rigid rear support member, a pair of wrist encircling members, and an elongated flexible member. The abdominal encircling member extends around the user's abdomen and may be incorporated within a personal flotation device. The rigid support member extends vertically on the back region between the abdominal encircling member and the user's shoulder region. The elongated flexible member extends between the wrist encircling members and the rigid support member. The length of the elongated flexible member prevents the user from simultaneously extending both arms at the shoulder joint. In operation, pulling forces are transferred from the wrist encircling members to the rigid support member and then to abdominal encircling member. The wrist encircling members may optionally include load distribution systems that distribute pulling forces directly from the grip induced object to the wrists. Alternative embodiments of the present invention utilize the system for non-water skiing grip induced pulling force distribution. A second embodiment of the present invention relates to a method for anatomically distributing grip induced forces. The method includes extending an elongated flexible member between the user's wrists and a rigid support member, levering the rigid support member against the user's back, and abdominally circumferentially retaining the rigid support member in proximity to the user's abdomen. The method may optionally include additional acts to distribute grip induced pulling forces directly from an object to the user's wrists. Also, while embodiments are described primarily in reference to a water ski force distribution system, it will be appreciated that the teachings of the present invention are application to other areas. For example, embodiments may be utilized to efficiently distribute load carrying forces.

The following terms are defined as follows:

Encircling member—an object that entirely encircles or encloses around a particular region. For example, a belt is an encircling member because it encircles around a wearer's waist.

Slidable coupling—a coupling between two objects in which one object is able to translate or slide with respect to the other object. For example, a strap may be slidably coupled through a recess in a bag. The strap may simultaneously support the bag while also be able to translate lengthwise in relative positioning to the bag.

Abdomen—an anatomical region of the human body defined within the hip bone and the rib cage. In addition or in the alternative, the abdomen may be defined as the anatomical region in proximity to the abdominal muscles.

Shoulder region—An anatomical vertical region corresponding to the location of the shoulder bones including the shoulder blades.

Frontal region—an anatomical region referring to the area in front of the body. This region may also be referred to as the region on the front side of the coronal plane.

Sagital plane—an anatomical plane that vertically bisects the human body from the front to back.

Coronal plane—an anatomical plane that vertically bisects the human body from the side/profile.

Reference is initially made to FIG. 1, which illustrates an operational perspective view of a load distribution system in accordance with one embodiment of the present invention, designated generally at 100. The system 100 includes a wrist encircling member 105, an elongated flexible member 110, a rigid support member 115, and an encircling member 120. The system 100 is illustrated in a water ski operational stance so as to distribute pulling forces received from the tow rope 144. The illustrated system is configured to distribute the pulling forces directly from the handlebar 140 to the user's abdominal region, thereby minimizing muscular strain in the hands, arms, shoulders, and back. It will be appreciated that the grip to wrist force distribution system contained within the illustrated wrist encircling members is an optional component not necessary for embodiments of the present invention. Likewise, embodiments of the present invention may be applied to non-water skiing load distribution.

The wrist encircling members 105 are releasably coupled over and around the user's wrist region. The wrist encircling members 105 are designed to minimize proximal translation along the user's arm for efficient force transfer. The wrist encircling members 105 may include full gloves or partial hand covers to assist in gripping the object through which the pulling force is received. The glove or partial hand covers may also help anchor the wrist encircling member 105 to prevent proximal arm translation. The illustrated wrist encircling members 105 include an optional wrist load distribution system that directly transfers forces from the handlebar 140 to the wrist region. The specific wrist load distribution system is illustrated and discussed in more detail with reference to FIG. 5. Various rigid hooking mechanisms or other handlebar type couplers may alternatively be included to directly transfer the pulling force to the wrist region of the user. The system 100 may also require the user to maintain grip of an object (i.e. tow rope handlebar 140) while still distributing forces from the wrist region to the abdominal region.

The elongated flexible member 110 is independently coupled to each of the wrist encircling members 105. The elongated flexible member 110 extends from one wrist encircling member 105, to the rigid support member 115, and then back to the other wrist encircling member 105. The elongated flexible member 110 may be composed of any high tensile strength material such as nylon webbing, rope, cord, etc. The elongated flexible member 110 is a single elongated structure extending between the two wrist encircling members 105 and the rigid support member 115. However, multiple sections may be lengthwise coupled to create the single elongated structure. The length of the elongated flexible member 110 is specifically selected to prevent the user from simultaneously extending at least one arm in the frontal region with respect to their body. The length of the elongated flexible member 110 may also be affected depending on whether the elongated flexible member 110 is routed to the rigid support member 115 adjacent to the user's torso or on the outside of the user's arms. In order to accommodate different users and configurations, an adjustable length system may be included on the elongated flexible members 110. When properly configured, the elongated flexible member 110 will automatically become taut before the user's arms are both fully extended in a particular orientation, effectively transferring the pulling force loads from the wrists to the back region. The user may at any time overcome the load distribution system 100 by utilizing muscular force to slack the elongated flexible member 110. The coupling between the wrist encircling members 105 and the elongated flexible member 110 is configured to be anatomically fixed meaning that the coupling location should not significantly change as a result of applied load. The coupling between the elongated flexible member 110 and the rigid support member 115 is slidable, meaning that the elongated flexible member 110 is able to translate with respect to the rigid support member 115. This slidable coupling is necessary to maintain substantially full range of motion for the user and to accommodate for different user torso orientations with respect to the pulling force. For example, in FIG. 1, the user's left shoulder is oriented slightly closer to the handlebar 140 and therefore the elongated flexible member 110 is automatically adjusted with respect to the rigid support member 115 to be slightly longer between the left wrist encircling member 105 and the rigid support member 115.

The rigid support member 115 is positioned vertically between the user's abdomen and shoulder region in proximity to the user's back. The vertical or sagittal orientation of the rigid support member 115 is in substantial alignment with the user's spine. The rigid support member 115 is composed of a substantially rigid material to allow for leverage between an upper region and lower region. The illustrated embodiment utilizes an oval shaped hollow aluminum tube, but it will be appreciated that any material with similar properties or shape may be utilized in accordance with embodiments of the present invention. The upper region of the rigid support member 115 includes an outwardly curved region which assists in allowing the elongated flexible member 110 to translate with respect to the rigid support member 110. In addition, the outwardly curved region assists in generating a levering force so as to distribute the force received from the elongated flexible member 110 down to the user's abdominal region. The upper region of the rigid support member 115 also includes a recess or retaining region for the elongated flexible member 110. The recess enables the slidable coupling between the elongated flexible member 110 and the rigid support member 115 while still facilitating the force transfer characteristics. The lower portion of the rigid support member 115 is coupled and/or abdominally circumferentially retained by the encircling member 120 in proximity to the abdominal region of the user. It will be appreciated that both the rigid support member 115 and the encircling member 120 may be incorporated within some type of personal flotation device, garment, harnessing system, etc.

The encircling member 120 is configured to extend around the user's abdominal region. The encircling member 120 may also include some form of releasable clasping and adjustment system to engage the encircling member around the particular circumference of the user. Various padding and well known harness type support systems may be utilized to improve comfort and abdominal force distribution. The illustrated windsurfing type harness includes a large rear padded abdominal region and a VELCRO type releasable front closure system. The encircling member 120 is disposed around and/or coupled to the rigid support member in a manner to abdominally circumferentially retain the lower portion of the rigid support member 115 in proximity to the user's body, thereby vertically transferring forces from the rigid support member 115 to the encircling member 120.

In operation, a pulling force 150 is exerted upon the tow rope 144 and therefore the handlebar 140. The pulling force 150 is counteracted by the user engaging the handlebar 140. The pulling force 150 is initially counteracted and/or transferred from the handlebar 140 to the wrist region of the user via a hand to wrist force, 152 and is substantially absorbed by the wrist load distribution system illustrated and described in reference to FIG. 5. The force is then counteracted and/or transferred from the wrist region to the back region via a wrist to back force 154. As the user extends the arms about the elbow, the elongated flexible member 110 is automatically made taut between the wrist encircling members 105 and the rigid support member 115, thereby substantially absorbing the wrist to back force 154. The transferred pulling force 150 upon the top of the rigid support member 115 and the slidable coupling with the elongated flexible member 110 causes the top region of the rigid support member 115 to be forced toward the shoulder region of the user. The shape and orientation of the rigid support member 115 causes the force to be levered against the user's back or vertically transferred downward via the upper to lower back force 156. The leverage of the rigid support member 115 causes the lower region of the rigid support member 115 to be forced away from the user's abdominal region. The encircling member 120 circumferentially retains the lower region of the rigid support member 115 in proximity to the abdominal region and thereby transfers the force via the abdominal back to front force 120. The abdominal back to front force 120 is counteracted by the skeletal hip structure of the user. In addition, it will be appreciated that the abdominal back to front force is substantially forward toward the pulling force thereby naturally maintaining engagement between the user and the tow rope 144.

Figure 2:
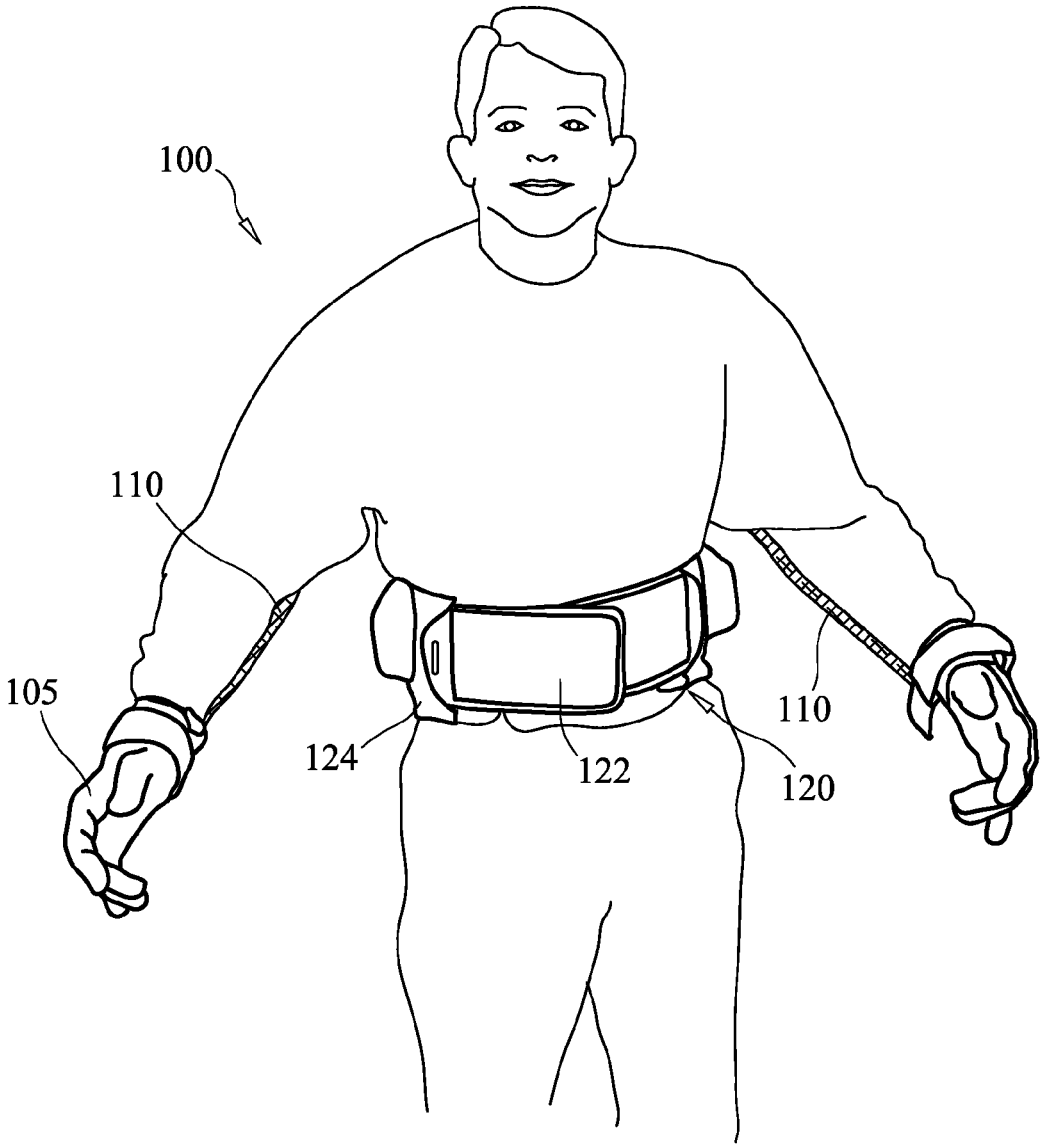
FIG. 2 illustrates a non-operational frontal view of the system illustrated in FIG. 1.

Reference is next made to FIG. 2, which illustrates a non-operational frontal view of the system illustrated in FIG. 1, designated generally at 100. The wrist encircling member 105, elongated flexible member 110, and encircling member 120 are all illustrated from the frontal perspective. The illustrated encircling member 120 includes a belt style VELCRO type releasable engagement and adjustment system 122 and a supportive hip region 124. Various harness system, adjustment system, coupling systems, accessories, etc. may be included on the encircling member 105 in accordance with embodiments of the present invention.

Figure 3:
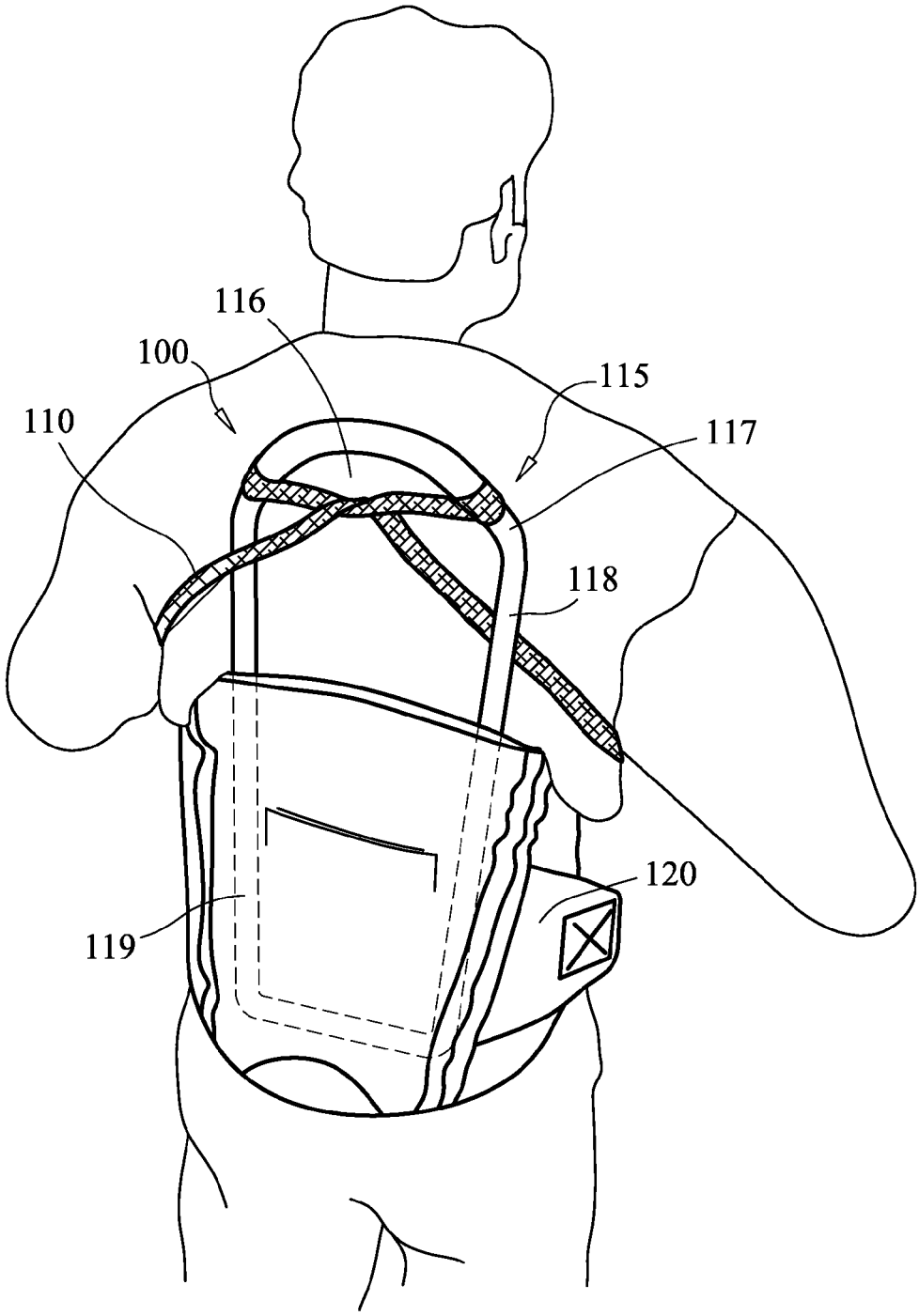
FIG. 3 illustrates a non-operational rear view of the system illustrated in FIG. 1.

Reference is next made to FIG. 3, which illustrates a non-operational rear view of the system illustrated in FIG. 1, designated generally at 100. The rigid support member 115, elongated flexible member 110, and encircling member 120 are all illustrated from the rear perspective. The rigid support member 115 is illustrated in detail including the outwardly curved region 117, retaining recess 116, upper region 118, and lower region 119. In addition, the general oval like shape of the rigid support member 115 is illustrated including a phantom representation of the region retained within the encircling member 120. The outwardly curved region 117 and the retaining recess 116 facilitate the slidable coupling between the rigid support member 115 and the elongated flexible member 110. The outwardly curved region 117 also facilitated the leveraging of the rigid support member 115 necessary to vertically transfer the pulling force from the upper region 118 to the lower region 119. The illustrated shape of the rigid support member minimizes forces being applied to the spin of the user by utilizing a substantially vertical parallel sided shape.

Figure 4:
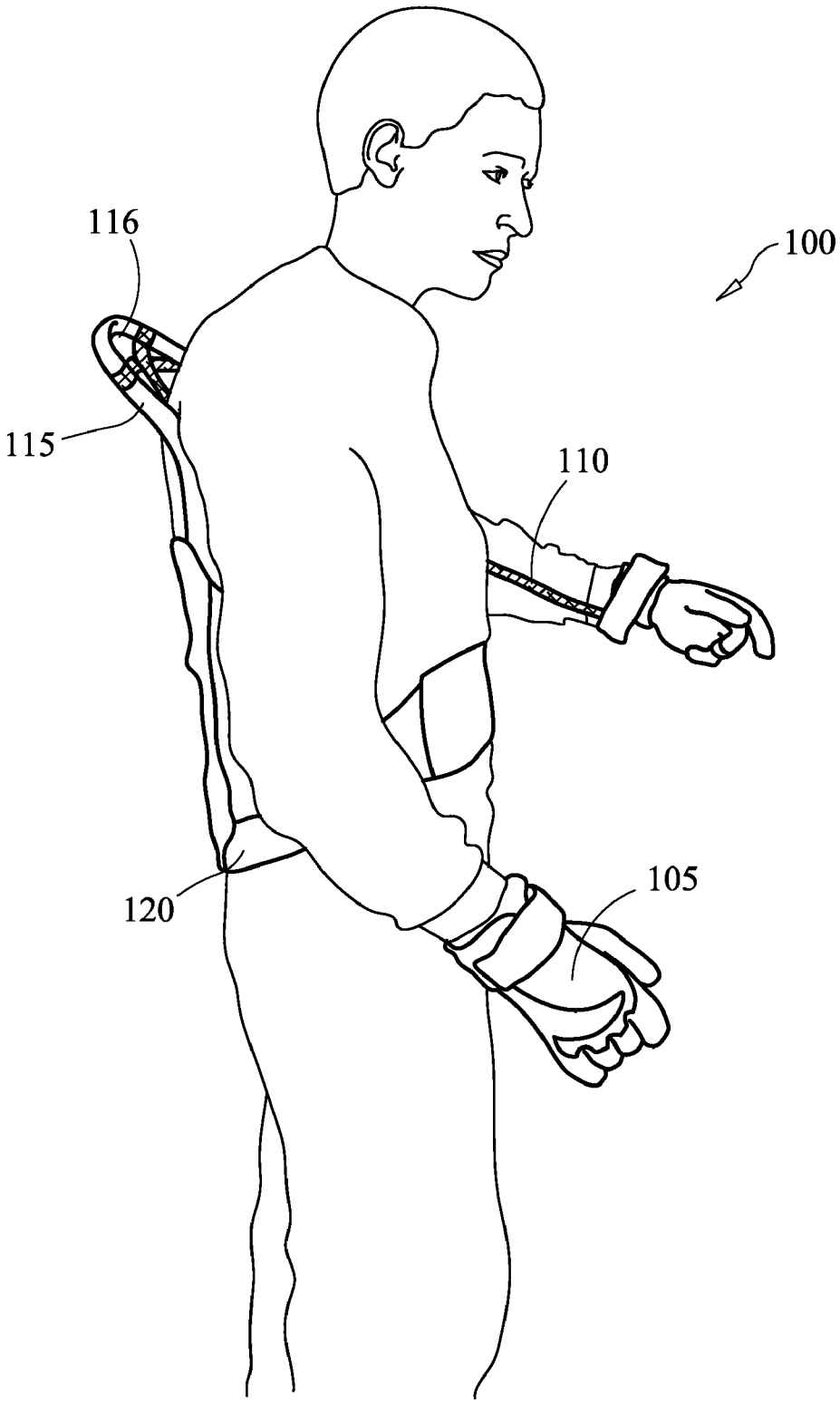
FIG. 4 illustrates a non-operational profile view of the system illustrated in FIG. 1.

Reference is next made to FIG. 4, which illustrates a non-operational profile view of the system illustrated in FIG. 1, designated generally at 100. The wrist encircling members 105, rigid support member 115, elongated flexible member 110, and encircling member 120 are all illustrated from the profile perspective. It will be noted that the elongated flexible member 110 may be oriented to extend in direct proximity to the user's torso as illustrated or on the outside of the user's arms for alternative characteristics.

Figure 5:
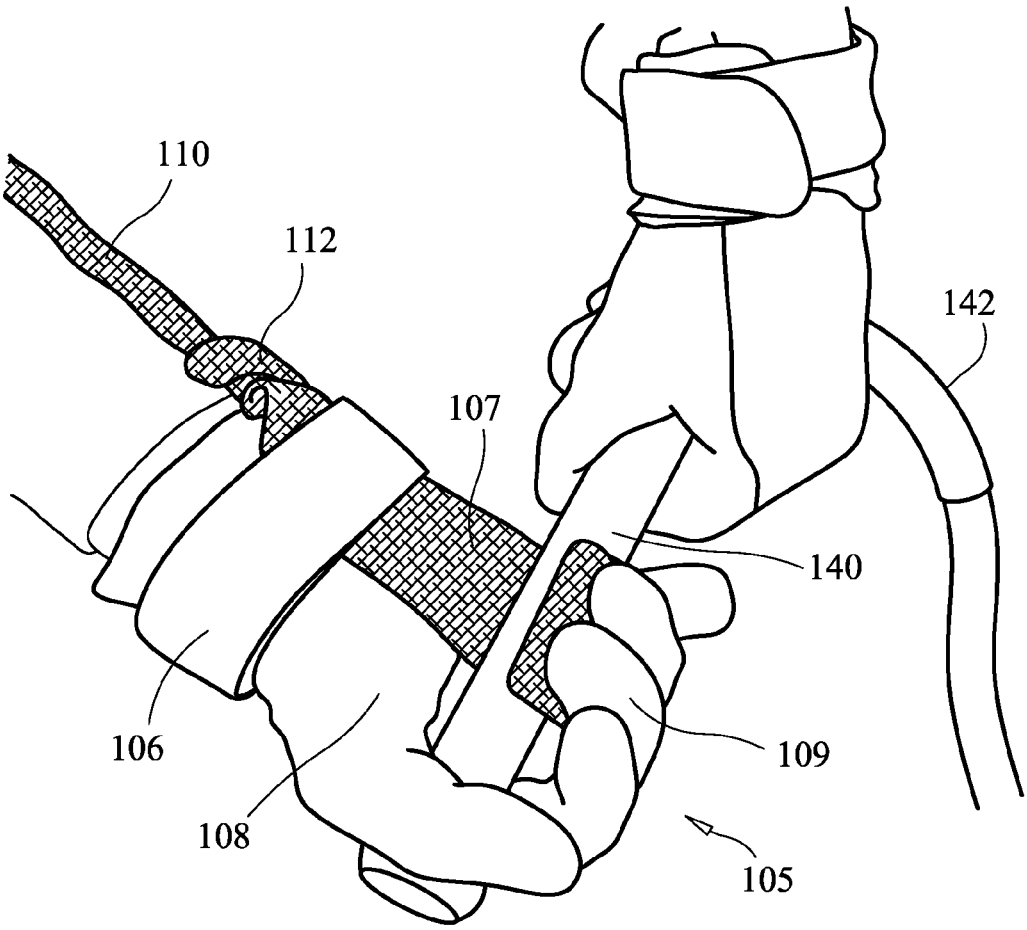
FIG. 5 illustrates a detailed perspective view of a portion of the system illustrated in FIG. 1.

Reference is next made to FIG. 5, which illustrates a detailed perspective view of the wrist encircling member 105 of the system illustrated in FIG. 1, designated generally at 105. The illustrated wrist encircling member 105 includes a wrist distribution system that effectively transfers grip induced loads to the wrist region. The system includes a palm region 108, a set of fingers 109, a wrist coupler 106, and an flexible member 107. The flexible member 107 is coupled to the wrist coupler 106 and the fingers 109 as illustrated. The flexible member 107 includes a particular stitching or hooking system at the fingers 109 designed to hook over the handlebar 140 and make taut the remaining length of the flexible member 107 extending to the wrist coupler 106. Therefore, the making taut of the flexible member 107 substantially transfers a pulling force from the handlebar 140 to the wrist without engaging the user's gripping muscles. The elongated flexible member 110 is also illustrated as being directly coupled 112 to the wrist coupled 106 of the wrist encircling member 105.

Figure 6:
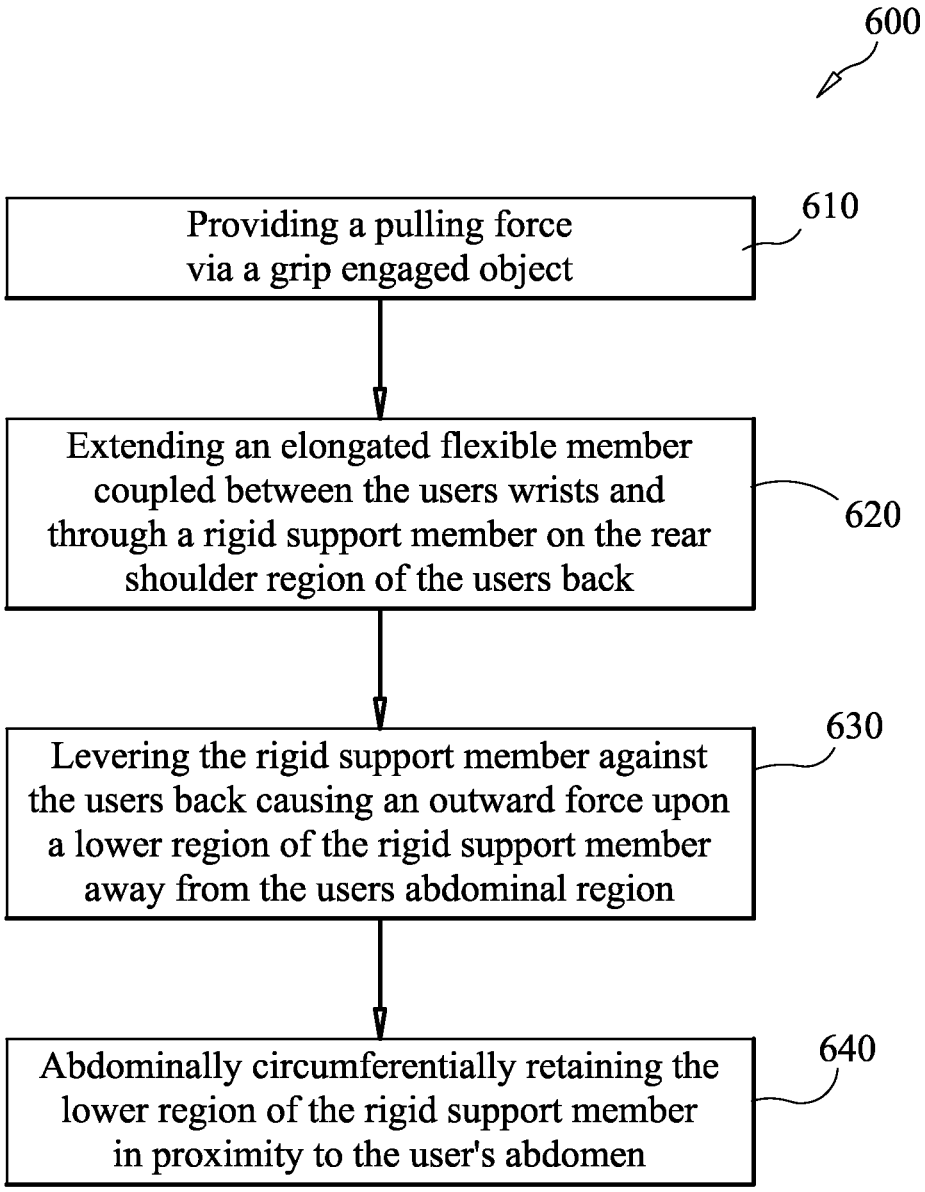
FIG. 6 illustrates a flow chart of a method for anatomically distributing pulling forces upon a user in accordance with a second embodiment of the present invention.

Reference is next made to FIG. 6, which illustrates a flow chart of a method for anatomically distributing pulling forces upon a user in accordance with a second embodiment of the present invention, designated generally at 600. The method includes providing a pulling force via a grip engaged object, act 610. An elongated flexible member is extended between the user's wrists and through a rigid support member located on the rear shoulder region of the user's back, act 620. The rigid support member is levered against the user's back causing an outward force upon a lower region of the rigid support member away from the user's abdominal region, act 630. The lower region of the rigid support member is abdominally circumferentially retained in proximity to the user's abdomen, act 640.

Figure 7:
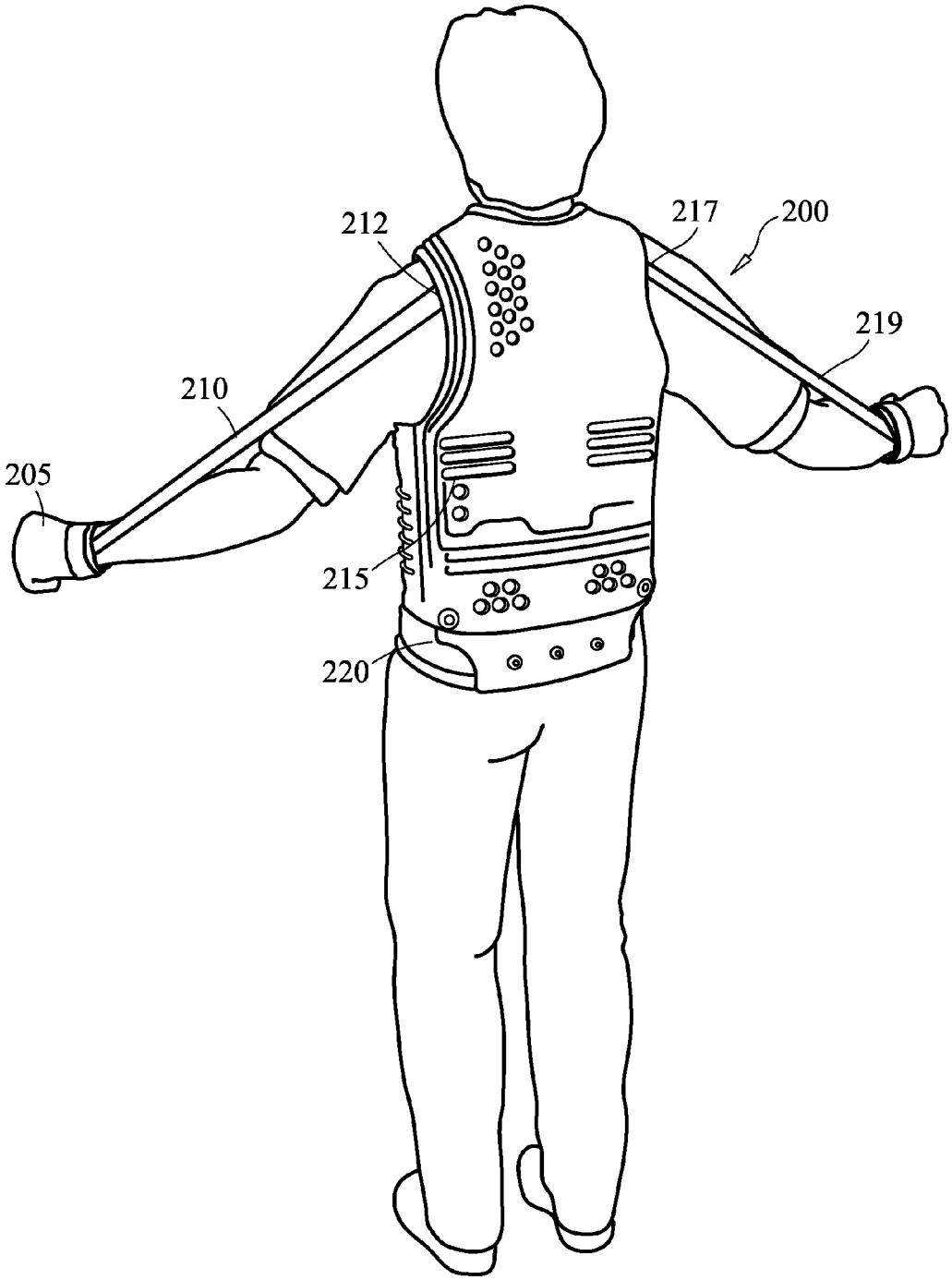
FIG. 7 illustrates a non-operational rear view of an alternative water ski specific system.

Reference is next made to FIG. 7, which illustrates an alternative water ski specific system embodiment designated generally at 200. The system 200 includes two wrist encircling members 205, two elongated flexible members 210, 219, a rigid support member 215, and an encircling member 220. The wrist encircling members 205 are releasably coupled over and around the user's wrist region. The specific illustrated wrist load distribution system is illustrated and discussed in more detail with reference to FIG. 5. In contrast to the previously discussed embodiments, the two elongated flexible members 210, 219 are separate and independently coupled to the rigid support member 215 via the couplings 212, 217. The couplings 212, 217 include a direct coupling between the two elongated flexible members 210, 219 and the rigid support member 215. In addition, the elongated flexible members are alternatively routed on the distal side of the user's arms. In this configuration, an optional length adjustment system (not illustrated) may be utilized to adjust the length of each of the elongated flexible members 210, 219 to correspond with the positioning of the elongated flexible members 210, 219 and the length of the user's arm so as to properly support forces during use. Various adjustment buckles, knotting systems, clasps, etc. may be utilized in accordance with embodiments of the present invention. The length of each elongated flexible member 210, 219 generally corresponds to a length at which the user is restricted from extending the corresponding arm about the elbow in a frontal region of the body. The exact orientation of the arm within the frontal region at which the elbow is restricted will depend on the preference of the user. The illustrated rigid support member 215 and encircling member 220 are incorporated together within a conventional water ski vest that include particular buoyancy properties. The integrated rigid support member 215 may include ABS or carbon materials to provide the rigid support properties. Likewise, the integrated encircling member may utilize conventional abdominal encircling systems present on water ski vests.

Various other embodiments have been contemplated, including combinations in whole or in part of the embodiments described above.

What is claimed is:

1. A load distribution system configured to anatomically distribute pulling forces exerted upon a user, comprising:
   - an encircling member configured to extend around a user's abdomen;
   - two wrist encircling members independently disposed over each of the user's wrists;
   - a rigid support member extending vertically between the user's abdomen shoulder region in proximity to the user's back, wherein a lower region of the rigid support member is coupled to the encircling member; and
   - an elongated flexible member having two ends slidably coupled to a region of the rigid support member, wherein the two ends are coupled to the two wrist encircling members, and wherein the length of the elongated flexible member extending between the two wrist encircling members is configured to prevent the user from extending at least one arm about the elbow in a frontal region.

2. The system of claim 1, wherein the encircling member includes an adjustable and releasable frontal clasping system.

3. The system of claim 1, wherein the encircling member and rigid support member are integrated with a personal flotation device.

4. The system of claim 1, wherein the wrist encircling members include gloves.

5. The system of claim 1, wherein the wrist encircling members independently include a hand load distribution system configured to distribute grip induced pulling forces from a finger region to a wrist region of wrist encircling member.

6. The system of claim 1, wherein the region of the rigid support member includes a recess through which the elongated flexible member is coupled and substantially retained.

7. The system of claim 1, wherein the region of the rigid support member is disposed in proximity to the user's shoulder region.

8. The system of claim 1, wherein the elongated flexible member is composed of nylon.

9. The system of claim 1, wherein rigid support member extends vertically in substantial alignment with the user's back.

10. The system of claim 1, wherein the slidable coupling between the elongated flexible member and the rigid support member includes extending the elongated flexible member through a recess in the upper region of the rigid support member.

11. A load distribution system configured to anatomically distribute pulling forces exerted upon a user, comprising:
   - an encircling member configured to extend around a user's abdomen;
   - two wrist encircling members independently disposed over each of the user's wrists;
   - a rigid support member extending vertically between the user's abdomen and shoulder region in proximity to the user's back, wherein a lower region of the rigid support member is coupled to the encircling member; and two elongated flexible members each having a first end coupled to a region of the rigid support member in proximity to the user's shoulder region, wherein the two elongated flexible members further include a second end coupled independently to one of the two wrist encircling members, and wherein the length of each of the elongated flexible members between the wrist encircling members and the rigid support member are independently configured to prevent the user from extending the corresponding arm about the elbow in a frontal region.

12. The system of claim 11, wherein the two elongated flexible members include a length adjustment system.

13. The system of claim 11, wherein the rigid support member and encircling member are integrated within a personal flotation device.

14. A method for anatomically distributing pulling forces upon a user comprising the acts of:

providing a user receiving a pulling force via a grip engaged object;

extending an elongated flexible member coupled between the user's wrists through a rigid support member disposed on a rear region of the user thereby preventing the user from extending at least one arm about the elbow;

levering an upper region of the rigid support member toward at least one of the user's back and shoulders causing an outward force upon a lower region of the rigid support member away from the user's lower back; and abdominally circumferentially retaining the lower region of the rigid support member in proximity to the user's abdomen.

15. The method of claim 14, further including extending a second elongated flexible member coupled between the user's fingers, around the grip engaged object, and the user's wrist.

16. The method of claim 14, further including lengthwise translating the elongated flexible member with respect to the rigid support member in correspondence with the user's torso alignment with the pulling force.

17. The method of claim 14, wherein the act of extending an elongated flexible member coupled between the user's wrists through a rigid support member disposed on the rear region of the user thereby impeding the user from extending at least one arm about the elbow further includes extending the elongated flexible member directly adjacent to the user's torso in proximity to the user's shoulder region.

18. The method of claim 14, wherein the act of extending an elongated flexible member coupled between the user's wrists through a rigid support member disposed on the rear region of the user thereby preventing the user from extending at least one arm about the elbow further includes making the elongated flexible member taut between both of the user's wrists and the rigid support member.

19. The method of claim 14, wherein the act of levering an upper region of the rigid support member toward at least one of the user's back and shoulders causing an outward force upon a lower region of the rigid support member away from the user's lower back further includes disposing the rigid support member in substantial sagittal alignment with the user's spine.

20. The method of claim 14, wherein the act of abdominally circumferentially retaining the lower region of the rigid support member in proximity to the user's abdomen further includes releasably engaging an encircling member around the user's abdomen.

* * * * *